United States Patent [19]

Muz

[11] Patent Number: 4,835,340

[45] Date of Patent: May 30, 1989

[54] CABLE WITH MOISTURE RESISTANT TINSEL CONDUCTORS

[75] Inventor: Edwin Muz, Reutlingen, Fed. Rep. of Germany

[73] Assignee: Nicolay GmbH, Kirchheim Teck, Fed. Rep. of Germany

[21] Appl. No.: 162,963

[22] Filed: Mar. 2, 1988

[30] Foreign Application Priority Data

Mar. 28, 1987 [DE] Fed. Rep. of Germany ..... 3710298

[51] Int. Cl.[4] ..... H01B 5/14; H01B 7/28

[52] U.S. Cl. ..... 174/119 R; 174/128.1; 174/130; 174/131 A

[58] Field of Search ..... 174/119 R, 128 R, 130, 174/131 R, 131 A, 131 B

[56] References Cited

U.S. PATENT DOCUMENTS

| | | | |
|---|---|---|---|
| 1,200,319 | 10/1916 | Currier | 174/119 R |
| 1,275,469 | 8/1918 | Pruessman | 174/131 A |
| 1,879,612 | 8/1931 | Massingham | 174/113 O |
| 2,004,592 | 6/1935 | Alden | 174/131 A |
| 2,240,579 | 5/1941 | Schumacher et al. | 174/131 A |
| 2,313,234 | 3/1943 | Gavitt | 174/131 R |
| 3,333,045 | 7/1967 | Fisher et al. | 174/130 |
| 3,490,125 | 1/1970 | Frieling, Jr. | 174/128 R |
| 3,710,008 | 1/1973 | Sawyer | 174/131 A |
| 4,033,357 | 7/1977 | Helland et al. | 128/785 |
| 4,365,634 | 12/1982 | Bare et al. | 128/640 |
| 4,567,321 | 1/1986 | Harayama | 174/131 A X |

*Primary Examiner*—Morris H. Nimmo

*Attorney, Agent, or Firm*—Roylance, Abrams, Berdo & Goodman

[57] ABSTRACT

A cable which can be exposed to moisture, especially for medical apparatus, has at least one electric tinsel conductor. The material of the metal foil has a high portion of nickel to prevent corrosion caused by moisture.

8 Claims, 1 Drawing Sheet

CABLE WITH MOISTURE RESISTANT TINSEL CONDUCTORS

FIELD OF THE INVENTION

The present invention relates to a cable which is exposed to moisture, especially for medical apparatus, with at least one electric tinsel conductor.

BACKGROUND OF THE INVENTION

In cables requiring high tear resistance and great alternating bending strength, electric tinsel conductors are conventionally used as inner conductors. In electric tinsel conductors, tin or silver plated copper tinsel or metal foil is wound helically on a carrier fiber. The carrier fiber is cotton or synthetic fibers. When such conventional cables are exposed to moisture, as frequently occurs in connection with medical apparatus, the tinsel strip or metal foil frequently corrodes after only a relatively short time. This corrosion can be attributed to penetrating moisture.

Until this time, there has been no successful and reliable mechanism for preventing the penetration of moisture into the cable. Therefore, the defective and insufficient corrosion resistance has been accepted in order to obtain the great tear resistance and excellent alternating bending strength of such conventional cables.

SUMMARY OF THE INVENTION

An object of the present invention is to provide a cable which has great tear resistance and high alternating bending strength by using electric tinsel conductors, and which is resistant to corrosion caused by moisture.

This object is attained by a cable which can be exposed to moisture, particularly for medical apparatus, comprising at least one electric tinsel conductor. The wound metal foil of the electric tinsel conductor is formed of a material having a high portion of nickel.

When the tinsel material has a high nickel content, any failure of the cable moisture protection which may occur has been proven not to disrupt the function of the electric tinsel conductors. Most importantly, the electric tinsel conductors do not corrode since the high nickel content tinsel itself resists corrosion. Although the resistance of high nickel content is considerably greater than that of copper tinsel, this increased resistance generally plays no role, and therefore, requires no switching features, modifications or the like in the attached apparatus.

The tinsel can be pure nickel. The required corrosion resistance can still be obtained, however, when the tinsel material consists of alloys containing a high portion of nickel, such as $CuNi_{10}Fe$, or German or nickel silver.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Highly flexible cable 1 has a high tear resistance and high alternating bending strength, and is intended for medical apparatus, for example, devices measuring an EKG or an EEG. The cable comprises highly flexible, but not moisture impenetrable sheathing 2 surrounding a plurality 3 of electrical tinsel conductors 4. The sheathing is formed of silicone, polyurethane or polytetrafluoroethylene (Teflon).

Figure 1:
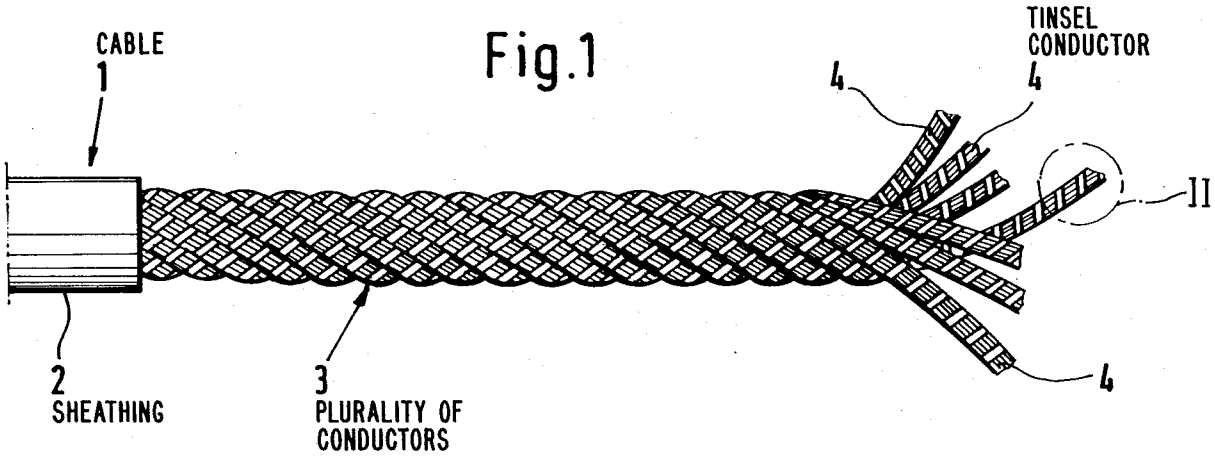
FIG. 1 is an enlarged, partial side elevational view, partially exploded, of a cable according to the present invention.
Figure 2:
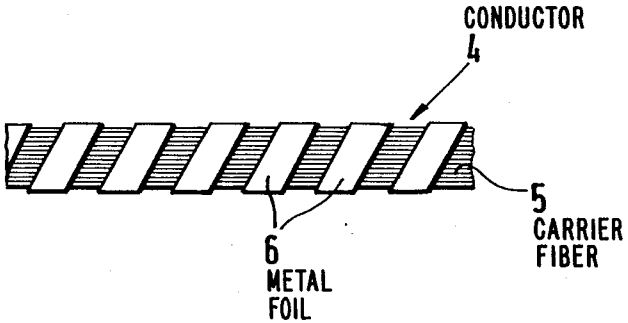
FIG. 2 is an enlarged, partial side elevational view of an electrical tinsel conductor of the cable of FIG. 1.

In the exemplary embodiment, the cable has seven tinsel conductors or fibers 4. As shown in FIG. 1, fibers 4 are stranded or braided in the manner which is conventional for electric tinsel conductors.

Each of the identical tinsel fibers 4 comprises a carrier fiber 5 and the tinsel or metal foil 6 which is wound on fiber 5 helically. The metal foil or strip of tinsel 6 is formed of a material having a high portion of nickel, and can be pure nickel, $CuNi_{10}Fe$ or German or nickel silver, and therefore, does not corrode in and of itself, if moisture penetrates through sheathing 2. Preferably, the percentage of nickel in tinsel or metal foil 6 is between about 20 and 100 percent.

While various embodiments have been chosen to illustrate the invention, it will be understood by those skilled in the art that various changes and modifications can be made therein without departing from the scope of the invention as defined in the appended claims.

What is claimed is:

1. A cable which can be exposed to moisture, particularly for medical apparatus, comprising:

at least one electric tinsel conductor with a nonconductive, flexible core and with a winding of metal foil wrapped about said core, said metal foil being formed of a material having a high portion of nickel.

2. A cable according to claim 1 wherein said material is substantially pure nickel.

3. A cable according to claim 1 wherein said material is $CuNi_{10}Fe$.

4. A cable according to claim 1 wherein said material is German silver.

5. A cable according to claim 1 wherein said material is nickel silver.

6. A cable according to claim 1 wherein said high portion of nickel is between about 20 and 100 percent.

7. A cable according to claim 1 wherein said tinsel conductor is surrounded by a sheathing.

8. A cable according to claim 7 wherein said sheathing comprises silicone, polyurethane or polytetrafluoroethylene.

* * * * *